US007005618B2

(12) United States Patent
Riddle et al.

(10) Patent No.: US 7,005,618 B2
(45) Date of Patent: Feb. 28, 2006

(54) CLOTHES DRYER APPARATUS AND METHOD

(75) Inventors: Douglas Allen Riddle, Louisville, KY (US); Zubair Hameed, Louisville, KY (US); Jeremy Michael Green, Louisville, KY (US)

(73) Assignee: General Electric Company, Schenectady, NY (US)

( * ) Notice: Subject to any disclaimer, the term of this patent is extended or adjusted under 35 U.S.C. 154(b) by 8 days.

(21) Appl. No.: 10/608,178

(22) Filed: Jun. 27, 2003

(65) Prior Publication Data

US 2004/0262293 A1 Dec. 30, 2004

(51) Int. Cl.
*H05B 1/02* (2006.01)

(52) U.S. Cl. ..... 219/497; 219/494; 219/501; 219/490; 34/535

(58) Field of Classification Search ..... 219/501, 219/497, 490, 499, 500, 492; 34/535, 321
See application file for complete search history.

(56) References Cited

U.S. PATENT DOCUMENTS

| | | | | |
|---|---|---|---|---|
| 3,633,094 | A * | 1/1972 | Clements | 323/236 |
| 4,209,915 | A | 7/1980 | Keuleman et al. | |
| 4,226,026 | A | 10/1980 | Deming et al. | |
| 4,282,422 | A * | 8/1981 | Payne et al. | 219/486 |
| 4,520,259 | A | 5/1985 | Schoenberger | |
| 4,649,654 | A | 3/1987 | Hikino et al. | |
| 2002/0096511 | A1 * | 7/2002 | Tsumanuma et al. | 219/501 |

FOREIGN PATENT DOCUMENTS

JP 402118319 * 5/1990

* cited by examiner

*Primary Examiner*—Mark Paschall
(74) *Attorney, Agent, or Firm*—George L. Ridgeout; Armstrong Teasdale LLP

(57) ABSTRACT

An electric clothes dryer heater system including a heater element and a controller operationally coupled to the heater is provided. The controller is configured to provide an AC sine wave to a heater element of an electric clothes dryer, stop providing at a zero crossing of the AC sine wave, monitor the AC sine wave for a subsequent zero crossing and reprovide the AC sine wave to the heater element at the subsequent zero crossing.

26 Claims, 5 Drawing Sheets

AC SINE WAVE MONITORED BY THE CONTROLLER

AC SINE WAVE PROVIDED TO THE HEATER

CLOTHES DRYER APPARATUS AND METHOD

BACKGROUND OF THE INVENTION

This invention relates generally to dryer systems and, more particularly, to heater control systems for clothes dryers.

An appliance for drying articles such as a clothes dryer for drying clothing articles typically includes a cabinet including a rotating drum for tumbling clothes and laundry articles therein. One or more heating elements heats air prior to air entering the drum, and the warm air is circulated through the drum as the clothes are tumbled to remove moisture from laundry articles in the drum. See, for example, U.S. Pat. No. 6,141,887.

At least one known clothes dryer utilizes an open loop control system to determine an appropriate amount of time for drying a load of clothes. The drying time is determined by an operator and entered using a manual control, such as a time selector switch. For the duration of the drying time, the heating elements are activated and deactivated to maintain warm air circulation inside the drum, and for more accurate control of the dryer heating elements, a temperature sensor, such as a thermostat or thermistor, is sometimes used in conjunction with the heating elements.

On at least some known dryers, the heating elements are cycled between a fully on state and a fully off state to maintain air temperature below a maximum allowable temperature. Every time this cycle occurs, the heating elements cool down in the off state and are reheated in the on state. The temperature fluctuations of the heater elements facilitate lowering the heat efficiency of the system.

BRIEF DESCRIPTION OF THE INVENTION

In one aspect, a method of limiting current includes providing an AC sine wave to at least one heater element of an electric clothes dryer, stopping the providing at a zero crossing of the AC sine wave, monitoring the AC sine wave for a subsequent zero crossing and reproviding the AC sine wave to the at least one heater element at the subsequent zero crossing.

In another aspect, an electric clothes dryer heater system includes a heater element and a controller operationally coupled to the heater. The controller is configured to provide an AC sine wave to at least one heater element of an electric clothes dryer, stop the providing at a zero crossing of the AC sine wave, monitor the AC sine wave for a subsequent zero crossing, and reprovide the AC sine wave to the at least one heater element at the subsequent zero crossing.

In another aspect, a dryer for tumble drying articles includes a drum including a cavity configured to hold articles to be dried, a motor drivingly coupled to the drum to rotate the drum, a heater element in flow communication with the cavity, a blower positioned to deliver heated air to the cavity, and a controller operationally coupled to the heater. The controller is configured to provide an AC sine wave to at least one heater element of an electric clothes dryer, stop the providing at a zero crossing of the AC sine wave, monitor the AC sine wave for a subsequent zero crossing, and reprovide the AC sine wave to the at least one heater element at the subsequent zero crossing.

In another aspect, a gas clothes dryer heater system includes a linear gas valve, a burner operationally coupled to the valve, and a controller operationally coupled to the valve. The controller is configured to control the valve in an on state such that the burner produces a first heat output, and to adjust the valve in the on state such that the burner produces a second heat output less than the first.

In yet another aspect, a dryer for tumble drying articles includes a drum comprising a cavity configured to hold articles to be dried, a motor drivingly coupled to the drum to rotate the drum, a linear gas valve, a burner operationally coupled to the valve and in flow communication with the cavity, a blower positioned to deliver heated air to the cavity, and a controller operationally coupled to the valve. The controller is configured to control the valve in an on state such that the burner produces a first heat output, and to adjust the valve in the on state such that the burner produces a second heat output less than the first.

DETAILED DESCRIPTION OF THE INVENTION

Figure 1:
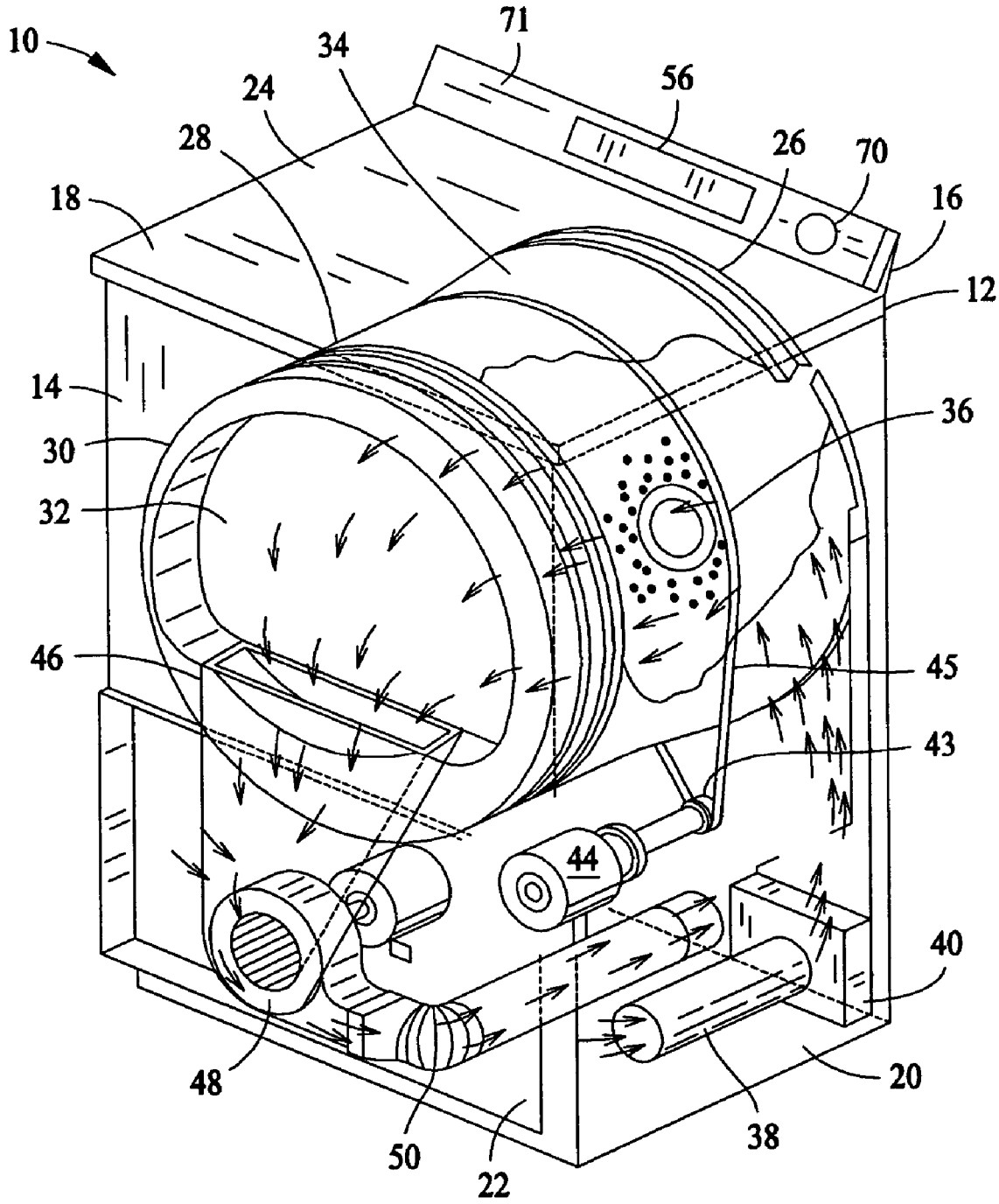
FIG. 1 is perspective broken away view of an exemplary dryer appliance.

FIG. 1 illustrates an exemplary clothes dryer appliance 10 in which the present invention may be practiced. While described in the context of a specific embodiment of dryer 10, it is recognized that the benefits of the invention may accrue to other types and embodiments of heating appliances such as a gas dryer. Therefore, the following description is set forth for illustrative purposes only, and the invention is not intended to be limited in practice to a specific embodiment of heating appliance, such as dryer 10.

Clothes dryer 10 includes a cabinet or a main housing 12 having a front panel 14, a rear panel 16, a pair of side panels 18 and 20 spaced apart from each other by front and rear panels 14 and 16, a bottom panel 22, and a top cover 24. Within cabinet 12 is a drum or container 26 mounted for rotation around a substantially horizontal axis. A motor 44 rotates the drum 26 about the horizontal axis through a pulley 43 and a belt 45. The drum 26 is generally cylindrical in shape, having an imperforate outer cylindrical wall 28 and a front flange or wall 30 defining an opening 32 of drum 26 for loading and unloading of clothing articles and other fabrics.

A plurality of tumbling ribs (not shown) are provided within drum 26 to lift clothing articles therein and then allow them to tumble back to a bottom (not shown) of drum 26 as drum 26 rotates. Drum 26 includes a rear wall 34 rotatably supported within main housing 12 by a suitable fixed bearing. Rear wall 34 includes a plurality of holes 36 that receive hot air that has been heated by an electrical heater 40 in communication with an air supply duct 38. The heated air is drawn from drum 26 by a blower fan 48. The air passes through a screen filter 46 which traps lint particles. As the air passes through the screen filter 46, it enters a trap duct seal and is passed out of clothes dryer 10 through an exhaust duct 50. After the clothing articles have been dried, they are removed from the drum 26 via opening 32.

A cycle selector knob 70 is mounted on a cabinet backsplash 71 and is in communication with a controller 56.

Signals generated in controller 56 operate the drum drive system and heating elements in response to a position of selector knob 70.

Figure 2:
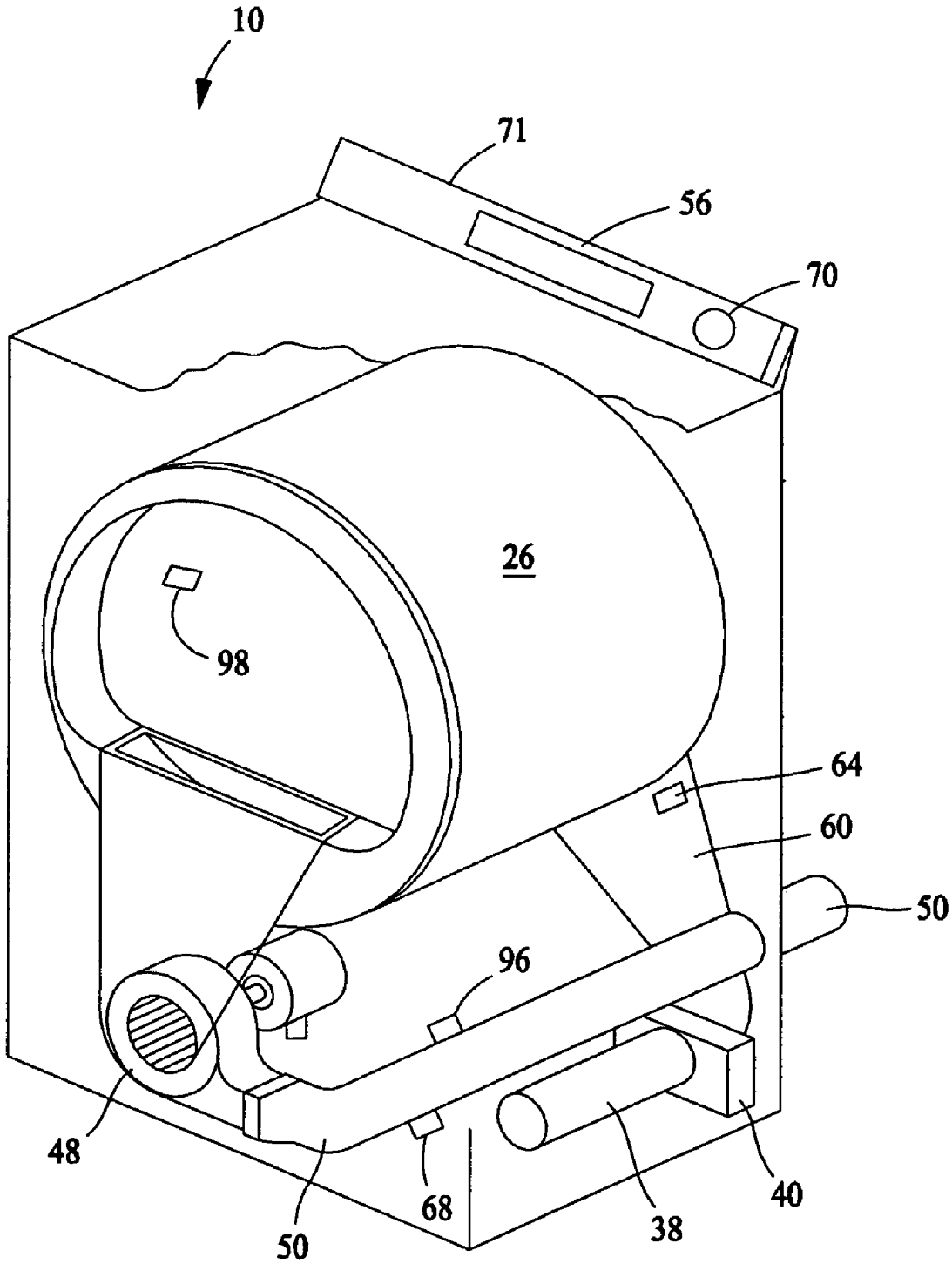
FIG. 2 is a perspective broken away view of the dryer appliance shown in FIG. 1 illustrating sensor locations.

With reference to FIG. 2, dryer 10 further includes a temperature sensor 64 at a drum hot air inlet 60 operable to produce a temperature signal indicative of an inlet air temperature. A second temperature sensor 68 is operable to produce a temperature signal indicative of a drum outlet temperature in outlet duct 50. A humidity sensor 96 is operable to produce a signal indicative of air humidity in outlet duct 50. A clothing moisture sensor 98 is operable to produce a signal indicative of a moisture level in the clothes through direct contact with the clothes in dryer drum 26. As moisture is removed from the clothes, a measured resistance between the clothes and the drum 26 increases as the clothes progress to a dry state.

Figure 3:
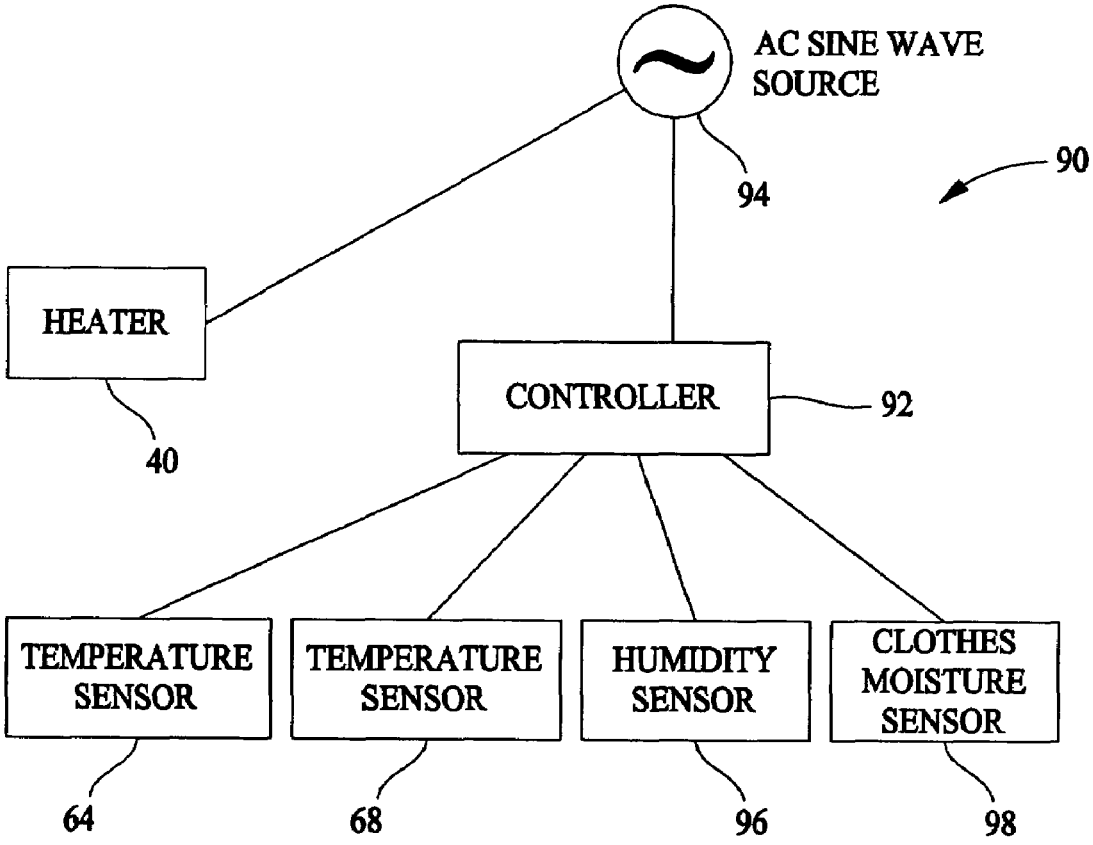
FIG. 3 is a waveform of the AC sine wave applied to the electrical clothes dryer heater element.

FIG. 3 illustrates an electric heater control system 90 including a controller 92 operationally coupled to an AC sine wave source 94 and heater 40. Controller 92 is also coupled to at least one of temperature sensors 64 and 68, a humidity sensor 96, and a clothing moisture sensor 98.

Controller 92 is programmed to perform functions described herein, and as used herein, the term controller is not limited to just those integrated circuits referred to in the art as controllers, but broadly refers to controllers, computers, microprocessors, microcontrollers, microcomputers, programmable logic controllers, application specific integrated circuits, field programmable gate arrays, and other programmable circuits, and these terms are used interchangeably herein.

Figure 4:
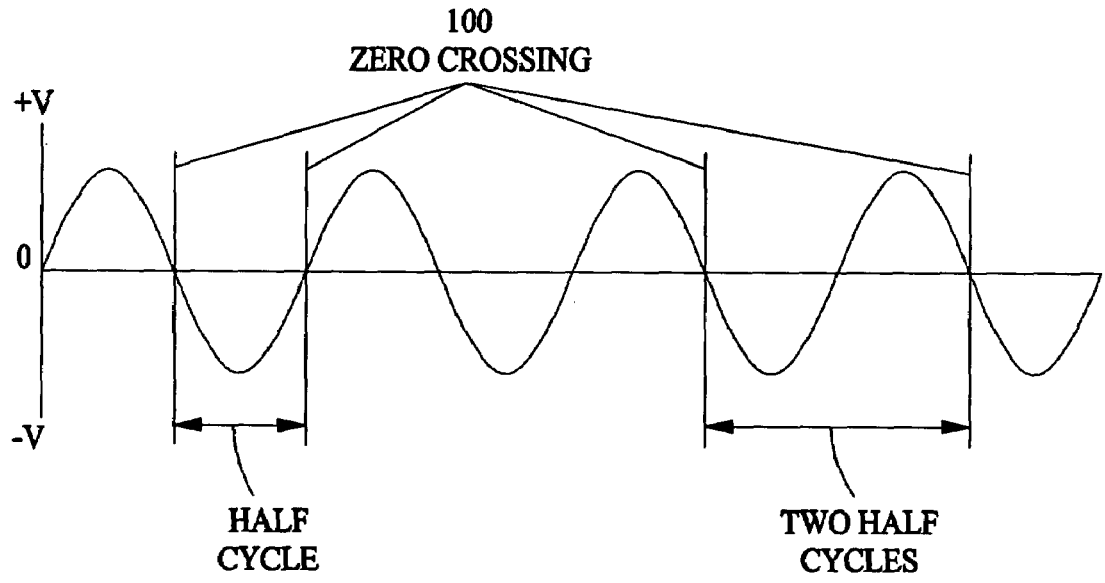
FIG. 4 is an electrical clothes dryer heater system.
Figure 4:
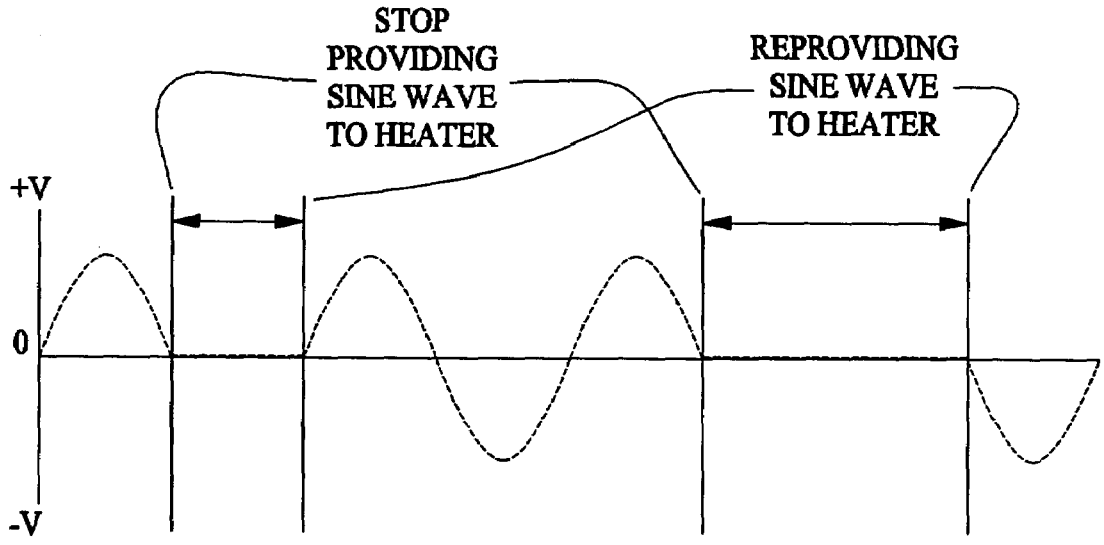

FIG. 4 illustrates a waveform of an AC sine wave controlled by heater control system 90 to limit the current through heater 40 of electric clothes dryer 10 to maintain an air temperature below a predetermined maximum allowable temperature. Controller 92 operation is based on an input signal from at least one of temperature sensors 64 and 68, humidity sensor 96, and clothing moisture sensor 98. The signals from these sensors 64, 68, 96 and 98 are used by the controller 92 to determine the timing and duration for stopping and reproviding the AC sine wave to the heater 40.

In use, controller 92 monitors temperature sensors 64 and 68, and varies the AC sine wave to heater 40 to maintain a predetermined temperature slightly below a maximum allowable temperature for the clothing being dried. Controller 92 monitors humidity sensor 96 and varies the AC sine wave to heater 40 to maintain a predetermined temperature to humidity relationship, wherein the outlet duct 50 air humidity is indicative of clothing dryness. Controller 92 monitors clothing moisture sensor 98 and varies the AC sine wave to heater 40 to maintain a predetermined temperature to moisture relationship, wherein the sensed moisture is indicative of clothing dryness. Controller 92 is configured to gradually reduce the voltage to heater 40 rather than turning heater 40 completely off. Controller 92 provides an AC sine wave to at least one heater 40 of clothes dryer 10, stops the providing at a zero crossing 100 of the AC sine wave, monitors the AC sine wave for a subsequent zero crossing 100, and reprovides the AC sine wave to the at least one heater 40 at the subsequent zero crossing 100.

During a normal cycle of an AC voltage sine wave, the voltage crosses the "x" axis, or zero, at 0 degrees and again at 180 degrees. During normal conditions, there are two zero crossings 100 in each cycle. Controller 92 stops providing and reprovides the AC sine wave at zero crossing 100. More specifically, after the initial providing of the AC sine wave to heater 40, controller 92 upon a determination to stop providing the AC sine wave to heater 40 based on the input signals from sensors 64, 68, 96 and 98, stops the AC sine wave at zero crossing 100 subsequent the moment of determination. Upon a determination to reprovide the AC sine wave to heater 40 based on the input signals from sensors 64, 68, 96 and 98, controller 92 reprovides the AC sine wave at zero crossing 100 immediately subsequent the zero crossing 100 at which the AC sine wave was stopped. The reproviding can also occur in at least two half cycles subsequent the zero crossing 100 at which the AC sine wave was stopped.

Stopping providing and reproviding the AC sine wave on a zero crossing 100 allows heater 40 to be controlled without any surge currents or inrush currents that may be present if the AC sine wave were stopped or reprovided while voltage was present. The herein described stopping of a providing and a reproviding of the AC sine wave at a zero crossing 100 also facilitates reducing the addition of any undesired electrical noise to the system.

Figure 5:
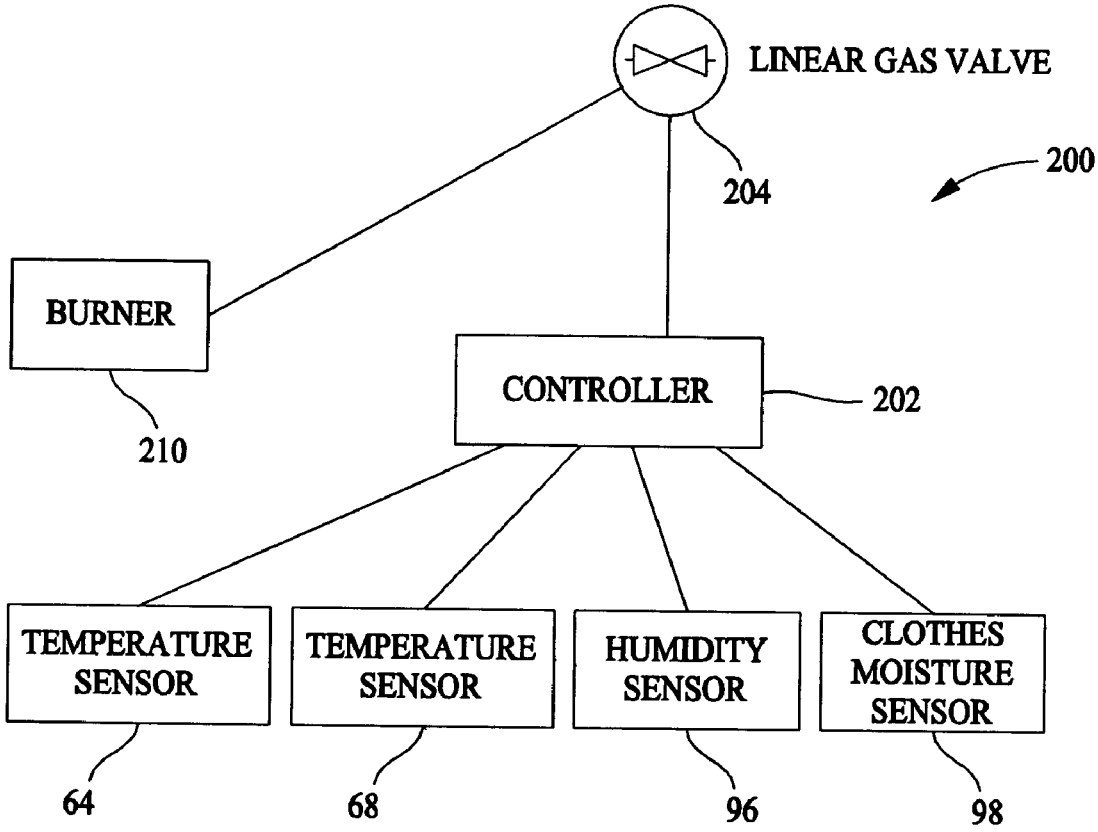
FIG. 5 is a gas clothes dryer heater system.

FIG. 5 illustrates a gas heater control system 200, which is included in gas embodiments of dryer 10. Gas heater control system 200 includes a controller 202 operationally coupled to a linear gas valve 204 and a burner 210. Controller 202 is also coupled to at least one of temperature sensors 64 and 68, a humidity sensor 96, and a clothing moisture sensor 98. Linear gas valve 204 is adjustable to vary the gas flow therethrough and subsequently vary the amount of gas ignited at burner 210. More specifically, controller 202 is in communication with valve 204 and adjusts valve 204 to vary a heat output of burner 210.

In use, controller 202 monitors temperature sensors 64 and 68, and varies the gas flow through linear gas valve 204 and therefore to burner 210 to maintain a predetermined temperature slightly below a maximum allowable temperature for the clothing being dried. In one embodiment, controller 202 also monitors humidity sensor 96 and varies the gas flow through linear gas valve 204 and therefore to burner 210 to maintain a predetermined temperature to humidity relationship, because outlet duct 50 air humidity is indicative of clothing dryness. In another embodiment, controller 202 monitors clothing moisture sensor 98 and varies the gas flow through linear gas valve 204 and therefore to burner 210 to maintain a predetermined temperature to moisture relationship, since the moisture level sensed is indicative of clothing dryness. Controller 202 is configured to reduce the heat output of burner 210 rather than turning burner 210 completely off.

Gas heater system 200, which adjusts linear gas valve 204 to vary burner 210 heat output to maintain the warm air circulation inside drum 26 without turning off burner 210, facilitates an increase in an average heat output of burner 210 over a clothes drying time and an increase in the efficiency of dryer 10 over known dryers which cycle heat sources between on and off states.

While the invention has been described in terms of various specific embodiments, those skilled in the art will recognize that the invention can be practiced with modification within the spirit and scope of the claims.

What is claimed is:

1. A method of limiting current, said method comprising:

providing an AC sine wave to at least one heater element of an electric clothes dryer;

stopping said providing at a zero crossing of the AC sine wave;

monitoring the AC sine wave for a subsequent zero crossing;

reproviding the AC sine wave to the at least one heater element at the subsequent zero crossing, wherein said reproviding comprises reproviding the AC sine wave to the at least one heater element at a zero crossing more than two half cycles subsequent the zero crossing at which the AC sine wave was stopped; and monitoring a dryer inlet air temperature, a dryer outlet air temperature, a dryer outlet humidity, and a moisture level within the dryer drum to control said stopping and said reproviding to maintain one of a predetermined dryer inlet air temperature to dryer outlet humidity relationship, a predetermined dryer outlet air temperature to dryer outlet humidity relationship, a predetermined dryer inlet air temperature to drum moisture relationship, and a predetermined dryer outlet air temperature to drum moisture relationship.

2. A method in accordance with claim 1 wherein said controlling comprises controlling said stopping and said reproviding with a controller based on an input signal from a temperature sensor.

3. A method in accordance with claim 1 wherein said controlling comprises controlling said stopping and said reproviding with a controller based on an input signal from a humidity sensor.

4. A method in accordance with claim 1 wherein said controlling comprises controlling said stopping and said reproviding with a controller based on an input signal from a clothing moisture sensor.

5. A method of limiting current, said method comprising:

providing an AC sine wave to at least one heater element of an electric clothes dryer;

stopping said providing at a zero crossing of the AC sine wave;

monitoring the AC sine wave for a subsequent zero crossing;

reproviding the AC sine wave to the at least one heater element at the subsequent zero crossing wherein said reproviding comprises reproviding the AC sine wave to the at least one heater element at a zero crossing immediately subsequent the zero crossing at which the AC sine wave was stopped; and monitoring a dryer inlet air temperature, a dryer outlet air temperature, a dryer outlet humidity, and a moisture level within the dryer drum to control said stopping and said reproviding to maintain one of a predetermined dryer inlet air temperature to dryer outlet humidity relationship, a predetermined dryer outlet air temperature to dryer outlet humidity relationship, a predetermined dryer inlet air temperature to drum moisture relationship, and a predetermined dryer outlet air temperature to drum moisture relationship.

6. A method in accordance with claim 5 wherein said controlling comprises controlling said stopping and said reproviding with a controller based on an input signal from a temperature sensor and a humidity sensor.

7. A method in accordance with claim 5 wherein said controlling comprises controlling said stopping and said reproviding with a controller based on an input signal from a temperature sensor and a clothing moisture sensor.

8. A method in accordance with claim 5 wherein said controlling comprises controlling said stopping and said reproviding with a controller based on an input signal from a humidity sensor and a clothing moisture sensor.

9. An electric clothes dryer heater system comprising:

a heater element;

a dryer inlet air temperature sensor;

a dryer outlet air temperature sensor;

a dryer outlet humidity sensor;

a dryer drum moisture sensor;

a controller operationally coupled to said heater, said dryer inlet air temperature sensor, said dryer outlet air temperature sensor, said dryer outlet humidity sensor, and said dryer drum moisture sensor, said controller configured to:

provide an AC sine wave to at least one heater element of an electric clothes dryer;

stop said providing at a zero crossing of the AC sine wave;

monitor the AC sine wave for a subsequent zero crossing; and reprovide the AC sine wave to the at least one heater element at the subsequent zero crossing, wherein to reprovide the AC sine wave to said at least one heater element, said controller configured to reprovide at a zero crossing more than two half cycles subsequent the zero crossing at which the AC sine wave was stopped;

wherein said AC sine wave is stopped and reprovided to maintain one of a predetermined dryer inlet air temperature to dryer outlet humidity relationship, a predetermined dryer outlet air temperature to dryer outlet humidity relationship, a predetermined dryer inlet air temperature to drum moisture relationship, and a predetermined dryer outlet air temperature to drum moisture relationship based on signals from said dryer inlet air temperature sensor, said dryer outlet air temperature sensor, said dryer outlet humidity sensor, and said dryer drum moisture sensor.

10. A system in accordance with claim 9 wherein said controller configured to stop and reprovide the AC sine wave based on an input signal from a temperature sensor.

11. A system in accordance with claim 9 wherein said controller configured to stop and reprovide the AC sine wave based on an input signal from a humidity sensor.

12. A system in accordance with claim 9 wherein said controller configured to stop and reprovide the AC sine wave based on an input signal from a clothing moisture sensor.

13. An electric clothes dryer heater system comprising:

a heater element;

a dryer inlet air temperature sensor;

a dryer outlet air temperature sensor;

a dryer outlet humidity sensor;

a dryer drum moisture sensor;

a controller operationally coupled to said heater, said dryer inlet air temperature sensor, said dryer outlet air temperature sensor, said dryer outlet humidity sensor, and said dryer drum moisture sensor, said controller configured to:

provide an AC sine wave to at least one heater element of an electric clothes dryer;

stop said providing at a zero crossing of the AC sine wave;

monitor the AC sine wave for a subsequent zero crossing; and reprovide the AC sine wave to the at least one heater element at the subsequent zero crossing, wherein to reprovide the AC sine wave to said at least one heater element, said controller configured to reprovide at a zero crossing immediately subsequent the zero crossing at which the AC sine wave was stopped;

wherein said AC sine wave is stopped and reprovided to maintain one of a predetermined dryer inlet air temperature to dryer outlet humidity relationship, a predetermined dryer outlet air temperature to dryer outlet humidity relationship, a predetermined dryer inlet air temperature to drum moisture relationship, and a predetermined dryer outlet air temperature to drum moisture relationship based on signals from said dryer inlet air temperature sensor, said dryer outlet air temperature sensor, said dryer outlet humidity sensor, and said dryer drum moisture sensor.

14. A dryer for tumble drying articles comprising:

a drum comprising a cavity configured to hold articles to be dried;

a motor drivingly coupled to said drum to rotate said drum;

a heater element in flow communication with said cavity;

a dryer inlet air temperature sensor;

a dryer outlet air temperature sensor;

a dryer outlet humidity sensor;

a dryer drum moisture sensor;

a blower positioned to deliver heated air to said cavity; and a controller operationally coupled to said heater, said dryer inlet air temperature sensor, said dryer outlet air temperature sensor, said dryer outlet humidity sensor, and said dryer drum moisture sensor, said controller configured to:

provide an AC sine wave to at least one heater element of an electric clothes dryer;

stop said providing at a zero crossing of the AC sine wave;

monitor the AC sine wave for a subsequent zero crossing; and reprovide the AC sine wave to the at least one heater element at the subsequent zero crossing, wherein to reprovide the AC sine wave to said at least one heater element, said controller configured to reprovide at a zero crossing more than two half cycles subsequent the zero crossing at which the AC sine wave was stopped;

wherein said AC sine wave is stopped and reprovided to maintain one of a predetermined dryer inlet air temperature to dryer outlet humidity relationship, a predetermined dryer outlet air temperature to dryer outlet humidity relationship, a predetermined dryer inlet air temperature to drum moisture relationship, and a predetermined dryer outlet air temperature to drum moisture relationship based on signals from said dryer inlet air temperature sensor, said dryer outlet air temperature sensor, said dryer outlet humidity sensor, and said dryer drum moisture sensor.

15. A dryer in accordance with claim 14 wherein said controller configured to stop and reprovide the AC sine wave based on an input signal from a temperature sensor.

16. A dryer in accordance with claim 14 wherein said controller configured to stop and reprovide the AC sine wave based on an input signal from a humidity sensor.

17. A dryer in accordance with claim 14 wherein said controller configured to stop and reprovide the AC sine wave based on an input signal from a clothing moisture sensor.

18. A dryer for tumble drying articles comprising:

a drum comprising a cavity configured to hold articles to be dried;

a motor drivingly coupled to said drum to rotate said drum;

a heater element in flow communication with said cavity;

a dryer inlet air temperature sensor;

a dryer outlet air temperature sensor;

a dryer outlet humidity sensor;

a dryer drum moisture sensor;

a blower positioned to deliver heated air to said cavity; and a controller operationally coupled to said heater, said dryer inlet air temperature sensor, said dryer outlet air temperature sensor, said dryer outlet humidity sensor, and said dryer drum moisture sensor, said controller configured to:

provide an AC sine wave to at least one heater element of an electric clothes dryer;

stop said providing at a zero crossing of the AC sine wave;

monitor the AC sine wave fir a subsequent zero crossing; and reprovide the AC sine wave to the at least one heater element at the subsequent zero crossing, wherein to reprovide the AC sine wave to said at least one heater element said controller configured to reprovide at a zero crossing immediately subsequent the zero crossing at which the AC sine wave was stopped;

wherein said AC sine wave is stopped and reprovided to maintain one of a predetermined dryer inlet air temperature to dryer outlet humidity relationship, a predetermined dryer outlet air temperature to dryer outlet humidity relationship, a predetermined dryer inlet air temperature to drum moisture relationship, and a predetermined dryer outlet air temperature to drum moisture relationship based on signals from said dryer inlet air temperature sensor, said dryer outlet air temperature sensor, said dryer outlet humidity sensor, and said dryer drum moisture sensor.

19. A gas clothes dryer heater system comprising:

a linear gas valve;

a burner operationally coupled to said valve; and a controller operationally coupled to said valve, said controller configured to:

control said valve in an on state such that said burner produces a first heat output; and adjust said valve in the on state such that said burner produces a second heat output less than the first based on an input signal from a temperature sensor.

20. A system in accordance with claim 19 wherein said controller configured to adjust said valve to gradually vary the heat output of said burner.

21. A system in accordance with claim 19 wherein said controller further configured to adjust said valve based on an input signal from a humidity sensor.

22. A system in accordance with claim 19 wherein said controller flasher configured to adjust said valve based on an input signal from a clothing moisture sensor.

23. A dryer for tumble drying articles comprising:

a drum comprising a cavity configured to hold articles to be dried;

a motor drivingly coupled to the drum to rotate said drum;

a linear gas valve;

a burner operationally coupled to said valve and in flow communication with said cavity;

a blower positioned to deliver heated air to said cavity; and a controller operationally coupled to said linear gas valve, said controller configured to:

control said valve in an on state such that said burner produces a first heat output; and adjust said valve in the on state such that said burner produces a second heat output less than the first.

24. A dryer in accordance with claim 23 wherein said controller configured to adjust said valve based on an input signal from a temperature sensor.

25. A dryer in accordance with claim 23 wherein said controller configured to adjust said valve based on an input signal from a humidity sensor.

26. A dryer in accordance with claim 23 wherein said controller configured to adjust said valve based on an input signal from a clothing moisture sensor.

* * * * *

UNITED STATES PATENT AND TRADEMARK OFFICE

CERTIFICATE OF CORRECTION

PATENT NO. : 7,005,618 B2
APPLICATION NO. : 10/608178
DATED : February 28, 2006
INVENTOR(S) : Riddle et al.

It is certified that error appears in the above-identified patent and that said Letters Patent is hereby corrected as shown below:

In Claim 5, column 5, line 34, delete “crossing wherein” and insert therefor -- crossing, wherein --.

In Claim 18, column 8, line 2, delete “fir” and insert therefor -- for --.

In Claim 18, column 8, line 7, delete “element said” and insert therefor -- element, said --.

In Claim 22, column 8, line 37, delete “flasher” and insert therefor -- further --.

Signed and Sealed this

First Day of July, 2008

JON W. DUDAS
*Director of the United States Patent and Trademark Office*